US009796512B2

(12) United States Patent
Bouline et al.

(10) Patent No.: US 9,796,512 B2
(45) Date of Patent: Oct. 24, 2017

(54) PACKAGING

(71) Applicant: Intercontinental Great Brands LLC, East Hanover, NJ (US)

(72) Inventors: Sebastien Bouline, Gex (FR); Nicolas Gres, Echevenex (FR)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 14/993,427

(22) Filed: Jan. 12, 2016

(65) Prior Publication Data

US 2016/0194119 A1 Jul. 7, 2016

Related U.S. Application Data

(62) Division of application No. 13/703,727, filed as application No. PCT/EP2011/059177 on Jun. 2, 2011, now Pat. No. 9,260,226.

(30) Foreign Application Priority Data

Jun. 16, 2010 (GB) ..... 1010080.8

(51) Int. Cl.
*B65D 47/36* (2006.01)
*B65D 77/02* (2006.01)
(Continued)

(52) U.S. Cl.
CPC ..... *B65D 47/36* (2013.01); *B65B 43/38* (2013.01); *B65D 5/5425* (2013.01); *B65D 75/5833* (2013.01); *B65D 75/5838* (2013.01); *B65D 77/02* (2013.01); *B65D 85/60* (2013.01); *B65D 2575/586* (2013.01)

(58) Field of Classification Search
None
See application file for complete search history.

(56) References Cited

U.S. PATENT DOCUMENTS 1,456,060 A 5/1923 Johnstone
1,543,865 A 6/1925 Muchmore
(Continued)

FOREIGN PATENT DOCUMENTS

CA 2 479 492 A1 2/2006
CN 101087726 A 12/2007
(Continued)

*Primary Examiner* — Christopher Demeree
(74) *Attorney, Agent, or Firm* — Hoffman & Baron, LLP

(57) ABSTRACT

A package assembly (20) comprises products enclosed in a tubular packet (24) formed from a flexible wrapper (26). A line of weakness (40) encloses an opening region (42) in a side wall (28) of the packet. The opening region (42) is at least partially removed to create a dispensing opening by tearing the wrapper along the line of weakness (40). In one embodiment, the packet is opened by pressing one of the products through the opening region. In another embodiment, a sticker (150, FIG. 3) is adhered to the opening portion to provide a tab (152, FIG. 3) which can be pulled to open the packet. In a further embodiment, the packet is enclosed in a stiff outer cover (260, FIG. 5). The cover has a reclosable flap (262) bonded to the opening region so that on first opening of the flap, the packet is torn along the line of weakness.

4 Claims, 7 Drawing Sheets

(51) Int. Cl.

| | |
|---|---|
| ***B65D 85/60*** | (2006.01) |
| ***B65D 75/58*** | (2006.01) |
| ***B65B 43/38*** | (2006.01) |
| ***B65D 5/54*** | (2006.01) |

(56) References Cited

U.S. PATENT DOCUMENTS

| | | | | | |
|---|---|---|---|---|---|
| 1,915,503 | A * | 6/1933 | Schmidt | B65D 85/1027 | 206/264 |
| 2,071,856 | A | 2/1937 | Segal | | |
| 2,729,326 | A | 1/1956 | Stadnyk | | |
| 3,141,602 | A | 7/1964 | Anderson | | |
| 3,260,405 | A | 7/1966 | Frischer et al. | | |
| 3,768,719 | A * | 10/1973 | Johnson | B65D 5/60 | 229/117.3 |
| 4,460,088 | A * | 7/1984 | Rugenstein | B65D 75/5838 | 206/264 |
| 5,018,625 | A * | 5/1991 | Focke | B65D 75/5838 | 206/494 |
| 5,040,685 | A * | 8/1991 | Focke | B65D 75/5838 | 206/494 |
| 5,048,687 | A | 9/1991 | Suzuki et al. | | |
| 5,269,404 | A * | 12/1993 | Wischusen, III | B65D 5/38 | 229/123.1 |
| 8,727,205 | B2 * | 5/2014 | Wipf | B65D 5/38 | 229/122 |
| 9,260,226 | B2 * | 2/2016 | Bouline | B65D 75/5833 | |
| 2003/0231808 | A1 | 12/2003 | Machacek et al. | | |
| 2004/0196256 | A1 * | 10/2004 | Wobbrock | G04G 21/08 | 345/156 |
| 2006/0124494 | A1 | 6/2006 | Clark, Jr. et al. | | |
| 2008/0017531 | A1 | 1/2008 | Tanbo et al. | | |
| 2011/0155738 | A1 * | 6/2011 | Miyake | A47K 10/421 | 220/359.1 |
| 2012/0043323 | A1 * | 2/2012 | Thomas | B65D 5/38 | 220/254.1 |

FOREIGN PATENT DOCUMENTS

| | | | |
|---|---|---|---|
| EP | 0 699 595 | A1 | 3/1996 |
| EP | 0 835 748 | A1 | 4/1998 |
| EP | 1 086 906 | A2 | 3/2001 |
| JP | 4011757 | B | 9/2007 |
| RU | 2286180 | C2 | 10/2006 |
| WO | 02/057147 | A1 | 7/2002 |
| WO | 03/082694 | A1 | 10/2003 |
| WO | 2007/110802 | A1 | 10/2007 |

* cited by examiner

PACKAGING

CROSS-REFERENCE TO RELATED APPLICATIONS

This application is a divisional of U.S. application Ser. No. 13/703,727, filed Feb. 21, 2013, which is a National Stage of International Application No. PCT/EP2011/059177, which designates the U.S., filed Jun. 2, 2011, which claims the benefit of Great Britain Application No. GB 1010080.8 filed Jun. 16, 2010, the contents of all which are incorporated by reference herein.

TECHNICAL FIELD OF THE INVENTION

The present invention relates to packaging.

BACKGROUND TO THE INVENTION

It is known to package consumable products by placing a number of the products side-by-side to form a stack and enclosing the stack in a tubular packet formed from a wrapper of flexible material. This type of packaging is used for a variety of consumable products such as biscuits and confectionery items, including gum pellets. FIG. 1 is a perspective view of a stack 10 of chewing gum pellets 12 packaged in this way. The wrapper 14 is folded circumferentially about the stack so that one side edge 14*a* of the wrapper overlaps another side edge and is held in place by means of adhesive or otherwise bonded to form a seal. The wrapper is longer than the stack products so that the ends of the wrapper extend beyond the ends of the stack. Each end of the wrapper is folded to provide end closure flaps which overlie their respective ends of the stack to form an end wall region 18. The flaps are usually held in place by means of adhesive or otherwise bonded so that the wrapper forms a sealed, tubular packet for the confectionery pellets. Sometimes a second, inner wrapper is provided which is folded about the product in a similar manner to the main or outer wrapper before the outer wrapper is applied. This is referred to as "double wrapped". However, in many cases only a single wrapper is used, which is referred to as "single wrapped". In some cases, each product in the stack is also individually wrapped.

Other food and confectionery items are also provided in the form of pellets, pastilles, tablets or the like and are suitable for packaging in the manner described above. For example, hard boiled sweets, candies, chocolates, toffee or mints may be provided in the form of pellets or pastilles as can may other types of candy both hard and soft.

The terms gum and chewing gum as used herein include bubble gum.

For use in packaging consumable goods, the wrapper is usually fabricated from a sheet of material that is substantially gas and moisture impervious and overlapping portions of the wrapper are adhered to one another so that the packet is fully sealed. Although for certain food and confectionery products, a hermetically sealed package is not desirable. Suitable wrappers can be made from a variety of materials including polymeric materials, metallic foil, and paper. Often the wrapper will be formed from a laminated sheet of material having two or more layers of material.

To assist a consumer in gaining access to the packaged products, it is common practice to provide a tear guide in or on the wrapper which assists a consumer in tearing the packet along a predetermined line. One known form of tear guide is a tear strip which is attached to an inner surface of the wrapper and is made of a material which is stronger than the wrapper. An end of the tear strip is exposed in the finished packet so that it can be grasped by a user and pulled to tear the wrapper along the line of the strip. Often the tear guide will be positioned to that it circumscribes the packet at or close to one end. A conventional tear strip arrangement is shown at 20 in FIG. 1.

Use of a tear strip is disadvantageous as it requires the manufacture and storage of an additional component, i.e. the strip, as well as an additional process step of applying the strip to the wrapper. This adds to the overall cost of manufacture. In addition, due to the nature of the materials used, wrappers that are gas and moisture impervious are often quite tough and can be difficult to tear in a predictable manner using a tear strip. To overcome these drawbacks, it is known to form one or more defined line of weakness in the wrapper to act as a tear guide. Lines of weakness can be formed by means of perforations which extend through the wrapper but this is not suitable where the product is perishable as the integrity of the sealed packet is lost. However, if the wrapper is a multi-layered, laminated sheet, then perforations or a score line can be provided in only one or some of the layers so that at least one layer is left intact to maintain the integrity of the packet prior to opening. In wrappers enclosing a stack of products, the line of weakness will usually be located so that an end region of the tubular packet is removed when the package is opened.

In the known arrangements, it is necessary for the wrapper to have an exterior tab that can be grasped by a user to initiate tearing along the line of weakness. This arrangement is not ideal as the exterior tab is prone to damage and there is the risk that the tab may get caught when the package assembly is moved so that tearing is prematurely initiated. Furthermore, an exterior tab is not always aesthetically pleasing to the consumer.

A further drawback with the conventional packaging arrangements is that the packet often cannot be re-closed so as to effectively retain and protect, at least to some degree, the remaining contents. This is a particular issue where the user will typically remove only one or a few of the products at a time and will wish to safely retain the remaining products for later consumption.

There is a need for an alternative packaging arrangement which overcomes or at least mitigates the disadvantages of the prior art arrangements.

There is also a need for an improved method of opening a packaging arrangement which overcomes, or at least mitigates, the disadvantages of the known methods.

SUMMARY OF THE INVENTION

In accordance with a first embodiment of the invention, there is provided a package assembly comprising a plurality of products, a tubular packet enclosing the products and formed from a wrapper of flexible material, the packet having a side wall region encircling the products, wrapper having at least one line of weakness fully or partially enclosing an opening region of the wrapper located in the side wall region of the packet, which opening region can be at least partially removed to create an opening in the wrapper through which one or more of the products may be dispensed by tearing the wrapper along the at least one line of weakness.

The least one line of weakness may only partially enclose the opening region such that the opening region remains attached to the remainder of the wrapper in the manner of a flap after tearing along the at least one line of weakness.

Alternatively, the at least one line of weakness may fully enclose the opening region such that the opening region can be removed completely to create the opening by tearing the wrapper along the at least one line of weakness.

The package assembly may be configured so that the packet can be ruptured along the at least one line of weakness to create an opening by pressing one of the products out of the packet through the opening region. The opening region may dimensioned so that it has an area which is only slightly larger than a cross sectional area of one of the products, where the cross sectional area is taken in a plane of the product which is aligned generally parallel to the opening region. The opening region may be dimensioned so that it has an area that is less than 1.5, or 1.4, or 1.3, or 1.2 or 1.1 times the cross sectional area of one of the products. The opening region may be dimensioned such that only one product can be dispensed through the opening at a time. The opening region may have a width which is larger than a corresponding dimension of one of the products but smaller than the combined corresponding dimensions of two of the products. The opening region may be positioned so that it aligns with one of the products in the unopened package assembly.

The wrapper may be made from a laminated material having an outer layer and one or more inner layers and the at least one line of weakness may be provided only in one or some of the inner layers. The at least one line of weakness may be provided only in an innermost layer of the wrapper. The wrapper may comprises a layer of metallic foil and a layer of paper positioned inwardly from the foil, the at least one line of weakness being provided in the paper layer. The paper layer may be the innermost layer of the wrapper. The metallic foil may be an aluminium foil. The wrapper may also comprise at least one layer of a polymeric material and more particularly a thermoplastic material such as polyethylene terephthalate (PET). The layer of polymeric material may be the outermost layer of the wrapper.

The wrapper may be printed on to provide the user with an externally visible indication of where the opening region is located and/or of where to press one of the products to open the packet. Where the wrapper is a laminate, the printing may be applied to the outermost layer. Alternatively, the wrapper may have an outermost layer which is transparent and the printing may be applied to an adjacent layer.

The packaging assembly may comprise a sticker which is adhered to the opening region of the wrapper, the sticker having a portion which defines a lifting tab that can be grasped by a user to effect tearing of the wrapper. The portion may extend over the line of weakness and may be secured to the wrapper outside the opening region by means of a peelable adhesive which may be a cold seal solution. The peelable adhesive may be re-sealable.

Where the packet is designed to be ruptured by pushing a product out through the opening region, a sticker may be adhered to the opening region of the wrapper and have a portion which extends over the line of weakness and is be secured to the wrapper outside the opening region by means of a peelable and resealable adhesive or otherwise peelably and re-sealably bonded. This will enable the packet to be reclosed.

The side wall region of the packet may define two pairs of opposed faces and the opening region may be defined wholly within one of the faces. The side wall region may define opposed front and back faces and opposed side faces and the opening region may be wholly located in one of the side faces or wholly located in one of the front and rear faces. The faces may all be of a similar width or the front and rear faces may be wider than the side faces. The faces may all be generally planar or at least one pair of opposed faces may be curved. In one embodiment, the side wall region has a pair of opposed, generally planer front and rear faces and a pair of opposed, curved side faces. In other embodiments, the side wall region may be generally circular in lateral cross section.

The package assembly may comprise an outer cover of foldable material of higher density and/or greater stiffness than the wrapper, the outer case having a flap movable between an open and a closed position, the flap being adhered, directly or indirectly, to the opening region of the wrapper such that on first movement of the flap from the closed position to the open position, the wrapper is torn along the at least one line of weakness to form an opening in the packet. The cover may comprise means for releasable securing the flap in the closed position. The flap may be releasably adhered to another portion of the cover to hold the flap in the closed position. The flap may be releasably adhered to another portion of the cover by means of a peelable and re-sealable adhesive or otherwise peelably and re-sealably bonded so that the flap can be re-closed. The cover may comprise a slot or tab with which a free end of the flap engages to releasably hold the flap in the closed position. The cover may encircle the side wall region of the tubular packet. The cover may comprise a sleeve which may extend of the whole length of the tubular packet or only over part of its length.

Where the side wall region of the packet comprises two pairs of opposed faces, the cover may have four face panels and a flap panel, each face panel being adhered to a corresponding one of the faces of the side wall region of the packet, a first of the face panels being adhered to the face of the wrapper in which the opening region is defined and having corresponding lines of weakness that define a corresponding opening region in the first face panel, at least part of the flap panel in the closed position overlying the first face panel and being adhered to the corresponding opening region such that initial movement of flap from the closed position to the open position tears both the first face panel and the wrapper along the corresponding lines of weakness to create an opening in the packet. Alternatively, the opening region of the wrapper may be defined in a first one of the faces of the side wall region and the cover may have three face panels which are each adhered to a corresponding one of the other three faces of the side wall region, at least part of the flap panel directly overlying the first face of the wrapper in the closed position and being adhered to the opening region so that on initial movement of the flap from the closed position to the open position, the wrapper is torn along the lines of weakness to create an opening in the packet.

The package assembly may comprise an outer cover formed from a foldable material of higher density and/or greater stiffness than the wrapper, the cover defining a sleeve surrounding the side wall region of the packet and being open at one end, the packet being slidable in the cover so that at least an end region of the packet can be slid out of the cover at said one end, the opening region of the wrapper being defined at least partially within said end region of the packet and the wrapper within the opening region being bonded to an inner surface of the cover such that when the end region is first slid out of the cover, the wrapper is torn along the at least one line of weakness to produce an opening in the end region of packet.

A slot may be defined in the cover at the opposite end from said one end through which a user may contact the packet in order to slide the end region of the packet out of said one end.

The cover may be made from a blank of foldable material such as cardboard, paperboard, or a polymeric material.

In accordance with a further embodiment of the invention, there is provided a package assembly comprising a plurality of products, a tubular packet enclosing the products and formed from a wrapper of flexible material, the packet having a side wall region encircling the products, wrapper having at least one line of weakness fully or partially enclosing an opening region of the wrapper located in the side wall region of the packet, which opening region can be at least partially removed to create an opening in the wrapper through which one or more of the products may be dispensed by tearing the wrapper along the at least one line of weakness, in which the package assembly is configured so that the packet can be ruptured along the at least one line of weakness to create an opening by pressing one of the products out of the packet through the opening region.

In accordance with a further embodiment of the invention, there is provided a package assembly comprising a plurality of products, a tubular packet enclosing the products and formed from a wrapper of flexible material, the packet having a side wall region encircling the products, wrapper having at least one line of weakness fully or partially enclosing an opening region of the wrapper located in the side wall region of the packet, which opening region can be at least partially removed to create an opening in the wrapper through which one or more of the products may be dispensed by tearing the wrapper along the at least one line of weakness, in which the wrapper is made from a laminated material having an outer layer and one or more inner layers and the at least one line of weakness may be provided only in one or some of the inner layers.

In accordance with a further embodiment of the invention, there is provided a package assembly comprising a plurality of products, a tubular packet enclosing the products and formed from a wrapper of flexible material, the packet having a side wall region encircling the products, wrapper having at least one line of weakness fully or partially enclosing an opening region of the wrapper located in the side wall region of the packet, which opening region can be at least partially removed to create an opening in the wrapper through which one or more of the products may be dispensed by tearing the wrapper along the at least one line of weakness, in which packaging assembly also comprises a sticker which is adhered to the opening region of the wrapper, the sticker having a portion which defines a lifting tab that can be grasped by a user to effect tearing of the wrapper.

In accordance with a further embodiment of the invention, there is provided a package assembly comprising a plurality of products, a tubular packet enclosing the products and formed from a wrapper of flexible material, the packet having a side wall region encircling the products, wrapper having at least one line of weakness fully or partially enclosing an opening region of the wrapper located in the side wall region of the packet, which opening region can be at least partially removed to create an opening in the wrapper through which one or more of the products may be dispensed by tearing the wrapper along the at least one line of weakness, in which the side wall region of the packet defines two pairs of opposed faces and the opening region is defined wholly within one of the faces.

In accordance with a further embodiment of the invention, there is provided a package assembly comprising a plurality of products, a tubular packet enclosing the products and formed from a wrapper of flexible material, the packet having a side wall region encircling the products, wrapper having at least one line of weakness fully or partially enclosing an opening region of the wrapper located in the side wall region of the packet, which opening region can be at least partially removed to create an opening in the wrapper through which one or more of the products may be dispensed by tearing the wrapper along the at least one line of weakness, in which the package assembly also comprises an outer cover of foldable material of higher density and/or greater stiffness than the wrapper, the outer cover having a flap movable between an open and a closed position, the flap being adhered, directly or indirectly, to the opening region of the wrapper such that on first movement of the flap from the closed position to the open position, the wrapper is torn along the at least one line of weakness to form an opening in the packet.

In accordance with a further embodiment of the invention, there is provided a package assembly comprising a plurality of products, a tubular packet enclosing the products and formed from a wrapper of flexible material, the packet having a side wall region encircling the products, wrapper having at least one line of weakness fully or partially enclosing an opening region of the wrapper located in the side wall region of the packet, which opening region can be at least partially removed to create an opening in the wrapper through which one or more of the products may be dispensed by tearing the wrapper along the at least one line of weakness, in which the package assembly comprises an outer cover formed from a foldable material of higher density and/or greater stiffness than the wrapper, the cover defining a sleeve surrounding the side wall region of the packet and being open at one end, the packet being slidable in the cover so that at least an end region of the packet can be slid out of the cover at said one end, the opening region of the wrapper being defined at least partially within said end region of the packet and the wrapper within the opening region being bonded to an inner surface of the cover such that when the end region is first slid out of the cover, the wrapper is torn along the at least one line of weakness to produce an opening in the end region of packet.

In accordance with a further embodiment of the invention, there is provided a method of opening a package assembly in accordance with the first aspect, the method comprising rupturing the packet along the at least one line of weakness by pressing one of the products out of the packet through the opening region.

Methods of manufacturing a package assembly as disclosed herein may also be claimed.

DETAILED DESCRIPTION OF THE INVENTION

Figure 16:
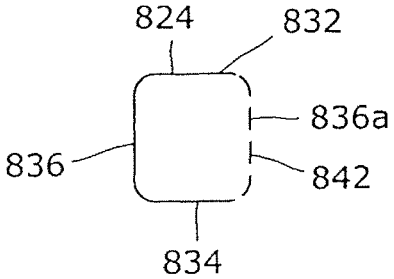
Figure 17:
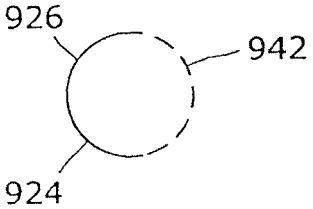

FIG. 16 is a schematic cross sectional view through a side wall region of a tubular packet forming part of a package assembly in accordance with an eighth embodiment of the invention, illustrating schematically the location of an opening region defined in the packet; and FIG. 17 is a schematic cross sectional view through a side wall region of a tubular packet forming part of a packaging assembly in accordance with a ninth embodiment of the invention, illustrating schematically the location of an opening region defined in the packet.

In the following description, the same reference numerals but increased by 100 in each case will be used to designate the same features or features which perform the same functions in each of the embodiments.

Figure 1:
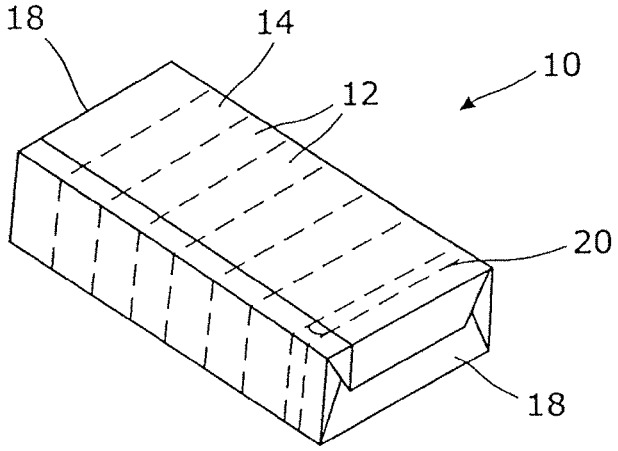
FIG. 1 is a perspective view of a package of stacked chewing gum pellets of the prior art.
Figure 2:
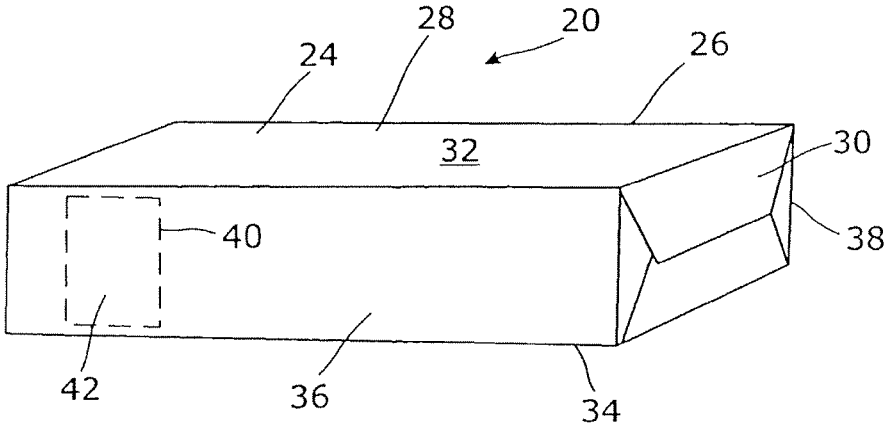
FIG. 2 is a perspective view of package assembly in accordance with a first embodiment of the invention.

FIG. 2 shows a package assembly 20 in accordance with the invention. The package assembly comprises tubular packet 24 which encases a stack of products (not shown in FIG. 2 but see 222 in FIG. 5). The tubular packet 24 is formed from a wrapper 26 of flexible material which is folded about the stack and sealed in a manner similar that shown in FIG. 1 and as described above. Accordingly, the tubular packet 24 has a side wall region 28 which encircles the stack of products, the ends of the tube being closed by means of end wall regions 30 constructed from folded flaps. In the present embodiment, the products 22 are chewing gum pellets which are shaped like small pillows having a rectangular outer periphery. As a result, the side wall region 28 of the wrapper is rectangular in lateral cross-section and has opposed front 32 and rear 34 faces and opposed side faces 36, 38.

To assist in opening the package assembly 20, a line of weakness 40 is formed in the wrapper 26 to provide a tear guide. The line of weakness 40 is positioned so as to encircle an area of the wrapper which is located wholly in one of the side faces 36 of the tubular packet. The area defined within the line of weakness is an opening region 42 of the wrapper which can be wholly or partially removed by tearing the wrapper along the line of weakness. In the present embodiment, the line of weakness completely encircles the opening region 42 so that it can be removed completely when the wrapper is torn along the line of weakness. However, in other embodiments, the line of weakness only partially encircles the opening region 42 so that it remains attached to the remainder of the wrapper but is able to be folded or deflected sufficiently to enable the products to be dispensed. The line of weakness 40 could, for example, extend only around three sides of the opening region 42 so that it remains attached along one side and can be deflected in the manner of a flap to create an opening.

The line of weakness 40 is arranged so that the packet 24 can be ruptured along the line of weakness by a user pressing one of the products 22 out through the opening region 42 from the opposite side of the packet. To make it easier for the user to rupture the packet, the opening region 42 defined by the line of weakness 40 may be dimensioned so that it has an area which is only slightly larger than the cross sectional area of one of the products, where the cross sectional area of the product is taken in a plane parallel to the side face 36 of the packet in which the opening region 42 is located. The opening region 42 may be dimensioned so that it has an area that is less than 1.5, or 1.4, or 1.3, or 1.2 or 1.1 times the cross sectional area of one of the products. Advantageously, the opening region 42 is dimensioned such that only one product can be dispensed at a time through the opening formed when the packet is ruptured along the line of weakness. The opening region 42 could, for example, have a width which is larger enough for one of the products 22 to fit through but not large enough to allow two of the products to fit through at the same time. The opening region 42 is positioned in the wrapper so that it aligns with one of the products in the unopened package assembly 24.

The wrapper 26 can be made from any suitable foldable material such as paper, metallic foil and/or one or more polymeric materials such as polyethylene terephthalate (PET), polyethylene (PE) or orientated polypropylene (OPP). In one embodiment, the wrapper is made from a laminated material having an outer layer and one or more inner layers and the line of weakness 40 is formed in one or more of the inner layers. This arrangement means that there is at least one outer layer which remains intact to maintain the integrity of the packet prior to opening. In addition, the package has an improved exterior appearance as there are no lines of weakness visible on the outside of the pack and the arrangement is more hygienic as no external debris or contaminants can collect in the line of weakness, as might be the case when the line of weakness is provided in the outer layer in the usual manner. In one embodiment, the wrapper has a layer of aluminium foil and a layer of paper positioned inwardly from the foil, and the lines of weakness are formed in the paper layer. The wrapper 26 may also have a further layer of a polymeric material, which may be a thermoplastic material such as PET. The layer of polymeric material may be located on the outside of the aluminium foil. In other embodiments, the wrapper may comprise PE/OPP or OPP/OPP laminate structures.

The line of weakness can be formed using any suitable method such as by scoring. However, a particularly convenient method is to produce the line of weakness by laser etching the inner layer. Where the wrapper comprises an inner layer of paper adjacent a layer of metallic foil, the wave length of the laser can be selected so that it is absorbed by the paper and reflected by the metallic foil so that the line of weakness is formed in the inner paper layer only. The line of weakness may be continuous or the laser may be pulsed to that a discontinuous line of weakness is formed.

To wrapper 26 can be printed on to provide a consumer with guidance and instructions for opening the packet. For example, the wrapper can be printed on to provide the user with an externally visible indication of where the opening region 42 and/or the line of weakness 40 are located and/or of where to press on a product in order to rupture the packet. In the case of a laminated wrapper, the printing may be applied to the outermost layer. Alternatively, if the wrapper has an outermost layer which is transparent, the printing may be applied to an adjacent layer so as to be visible through the outermost layer.

Figure 3:
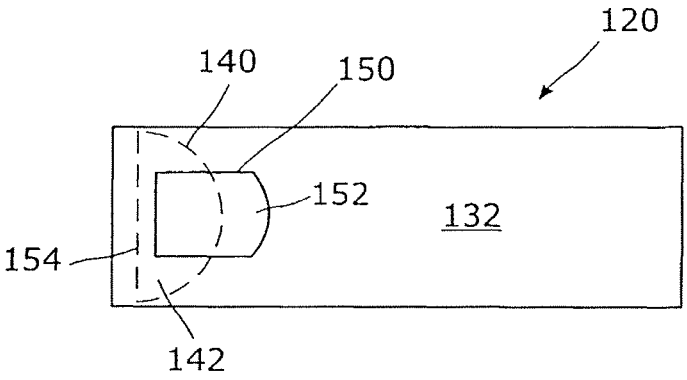
FIG. 3 is a plan view of a package assembly in accordance with a second embodiment of the invention.

A second embodiment of a package assembly 120 in accordance with the invention is illustrated in FIG. 3. The package assembly 120 is similar to the assembly 20 of the first embodiment, except that the line of weakness 140 in this embodiment is arranged to define a D shaped opening region 142 which is located in a front face 132 of the tubular packet 124. The line of weakness may be configured so that the packet can be ruptured by pushing one of the products out through the opening region as with the previous embodiment. However, as illustrated schematically in FIG. 3, an alternative arrangement for opening the packet can be provided in the form of a sticker 150 which is adhered to the opening region. A tab portion 152 of the sticker overlies the line of weakness 140 and is adhered to the wrapper outside of the opening region 142 using a peelable and resealable adhesive or a cold seal or any other suitable means for peelably and resealably bonding the tab portion. To open the packet, the user peels the tab portion from the wrapper and pulls the tab to tear the wrapper along the line of weakness 140. In the present embodiment, the opening region 142 remains attached to the wrapper along the straight edge 154 of the D so as to form an opening flap. This enables the packet 124 to be reclosed after opening by re-sticking the tab portion 152 of the sticker to the wrapper. This alternative arrangement for opening the packet 124 can be used with a variety of differently shaped opening regions and with opening regions located in any of the faces. It could for example be adopted in the embodiment shown in FIG. 2. A similar sticker arrangement can be used to enable a rupturable packet to be closed. In this case, the sticker will not form an opening tab as such but will overlie the line of weakness and be adhered to the wrapper outside of the opening region in a peelable and resealable manner so that it can be re-stuck after initial opening. In this embodiment, it is preferable if the opening region remains attached to the remainder of the wrapper in the manner of a flap.

Another embodiment of a package assembly 220 is shown in FIGS. 4 to 8. In this embodiment, the package assembly includes an additional cover 260 which is adhered to the outer faces of the side wall region of the packet 224. The cover includes a reclosable flap 262 which is operative to open the packet 224.

The tubular packet 224 is formed from a wrapper 226 of flexible material in the same manner and from the same materials as the packets 24, 124 described above in relation to the first two embodiments. A line of weakness 240 is provided which defines a trapezoidal opening region 242 in one of the side faces 236 of the packet. The line of weakness 240 extends around three sides of the opening region so that the opening region 242 remains attached to the remainder of the wrapper along the fourth side which is aligned with an edge of the side face 236.

Figure 8:
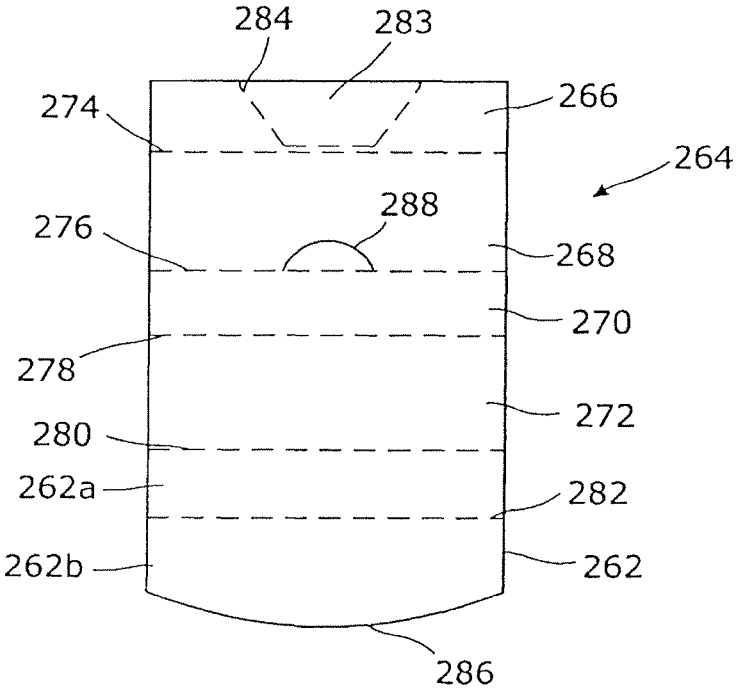
FIG. 8 is a plan view of a blank for a cover forming part of the package assembly of FIG. 4.

The cover is formed from a blank 264 of foldable material as shown in FIG. 8. The cover 260 is made from a material which his more dense and/or stiffer than the wrapper 226. Typically, the cover of formed from a blank of cardboard or paperboard or the like but any suitable materials can be used such as polymeric materials including plastics. The blank has first 266, second 268, third 270, and fourth 272, panel sections which are separated by fold lines 274-278. The blank also defines a flap 262 which is connected to the forth panel section 272 by a further fold line 280. The flap 262 is divided into a first flap section 262*a* and a second flap section 262*b* by a yet further fold line 282.

Figure 4:
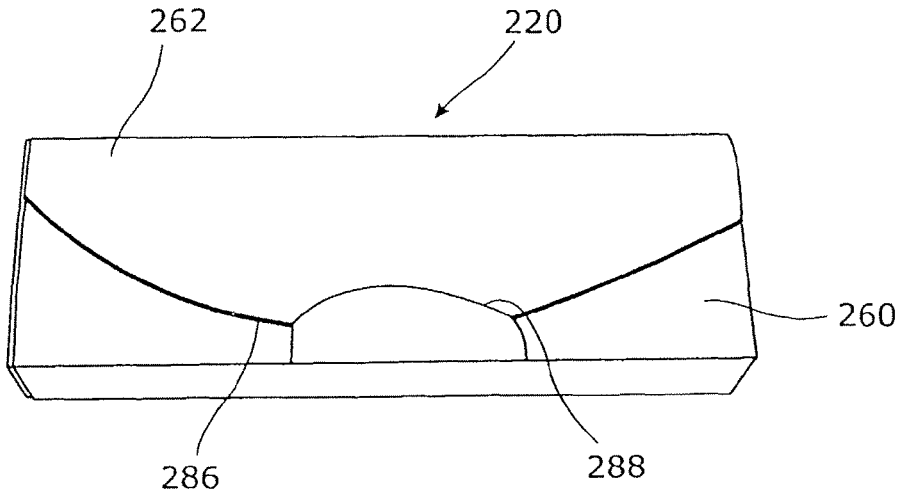
FIG. 4 is a plan view of a package assembly in accordance with a third embodiment of the invention including a reclosable cover.
Figure 5:
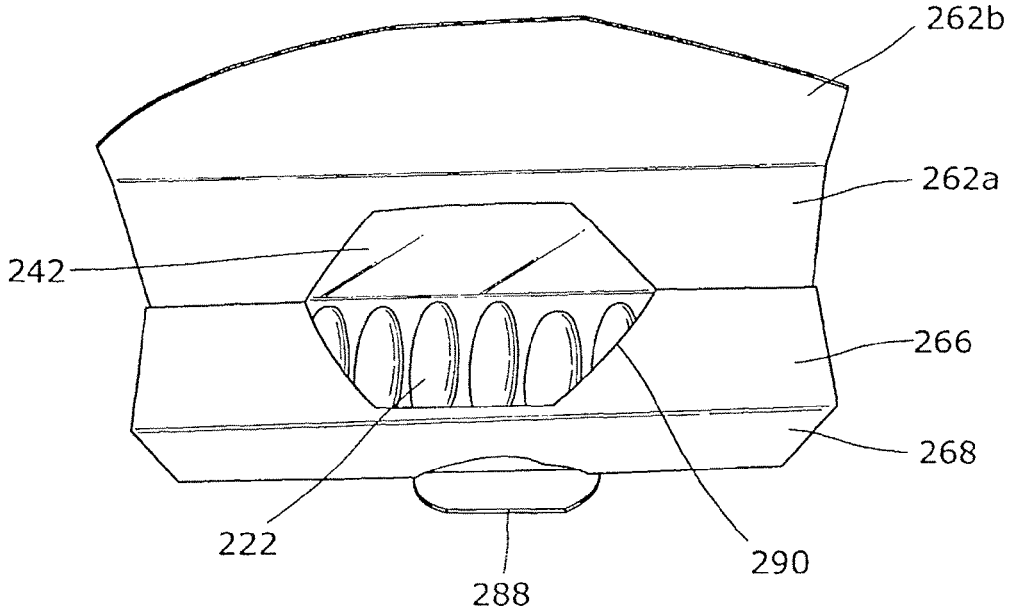
FIG. 5 is a perspective view of the package assembly of FIG. 4 in an open condition.
Figure 6:
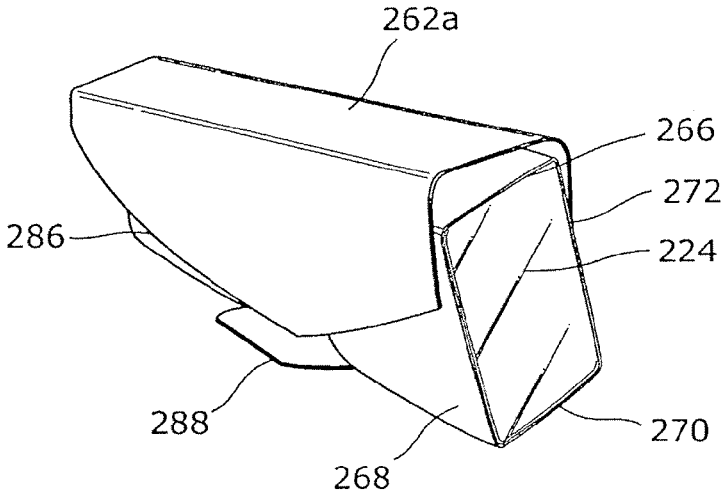
FIG. 6 is a perspective view from one side of the package assembly of FIG. 4, showing the cover being reclosed.
Figure 7:
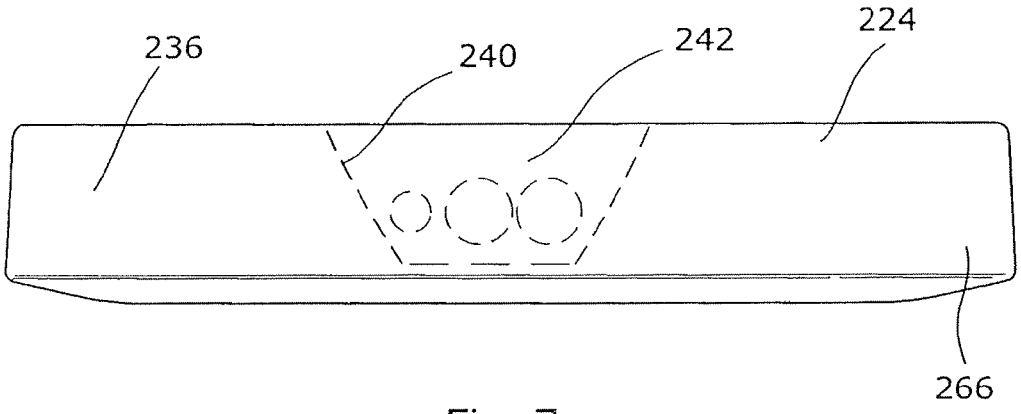
FIG. 7 is a side view of a packet forming part of the package assembly of FIG. 4.

The first panel section 266 of the blank is adhered to the side face 236 of the packet in which the opening region 242 is defined by the lines of weakness 240. A corresponding opening region 283 is defined in the first panel section by a line of weakness 284 which aligns with the line of weakness 240 in the packet. The second panel section 268 is adhered to a back face of the packet adjacent to the first side face 236, the third panel section 270 is adhered to the other side face and the fourth panel section 272 is adhered to the front face of the packet 224, as can be seen best in FIG. 6. The flap 262 is movable about the fold line 280 between a closed position as shown in FIG. 4 and an open position as shown in FIG. 5. In the closed position, the first section 262*a* of the flap overlies the first panel portion 266 and the second section 262*b* of the flap overlies part of the second panel section 268. A free end region 286 of the flap engages in a slot 288 formed in the second panel section 288 to hold the flap in the closed position.

When the package assembly 220 is manufactured, the first section 262*a* of the flap 262 is adhered to the corresponding opening region 283 in the first panel section 266, which is itself adhered to the opening region 242 in the packet. To open the package assembly for the first time, the user disengages the flap 262 from the slot 288 and moves the flap to the open position. Movement of the flap tears the first panel section 266 along the corresponding line of weakness 284 and at the same time tears the wrapper along the line of weakness 240 so that both the opening region 242 in the packet and the corresponding opening region 283 in the first panel section 266 are partially removed to create an opening 290 in the packet through which the products 222 can be dispensed. To close the package assembly, the user returns the flap 262 to the closed position and re-engages the end region 286 in the slot 288.

The cover may be printed on to provide information for the consumer including guidance for opening and closing the package assembly.

Figure 9:
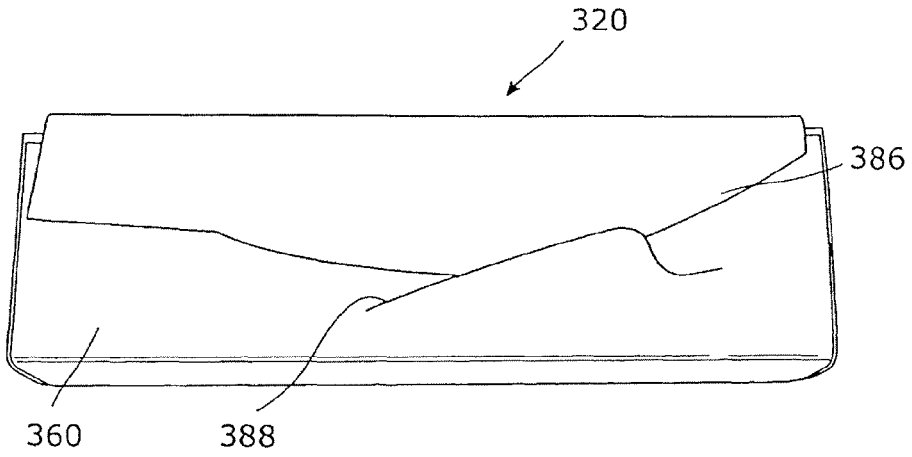
FIG. 9 is a plan view of a package assembly in accordance with a fourth embodiment of the invention.
Figure 10:
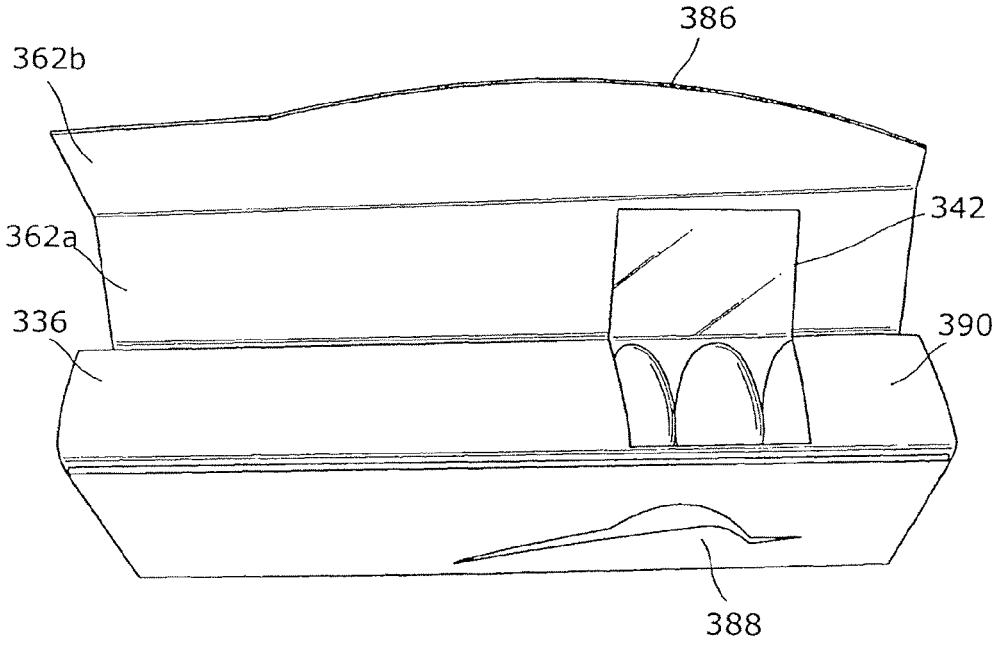
FIG. 10 is a perspective view of the package assembly of FIG. 9 in an open condition.

FIGS. 9 and 10 illustrate a further embodiment of a package assembly 320 in accordance with the invention. This embodiment is similar to the previous embodiment 220 and so only the differences will be descried in detail.

The main difference between the present embodiment 320 and the previous embodiment is that the cover 360 has only three panel sections arranged so that the side face 336 in which the opening region 342 is defined is not covered by a panel section. In this case, the first section 362*a* of the flap directly overlies the side face 336 in which the opening region 342 is defined and is adhered to the opening region so that when the flap is first opened, the wrapper is torn along the lines of weakness to create an opening 290 through which the products 322 can be dispensed.

The other main difference over the previous embodiment is that the free end region 386 of the flap 362 is not symmetrical and the slot 388 is offset to receive the free end region.

Figure 11:
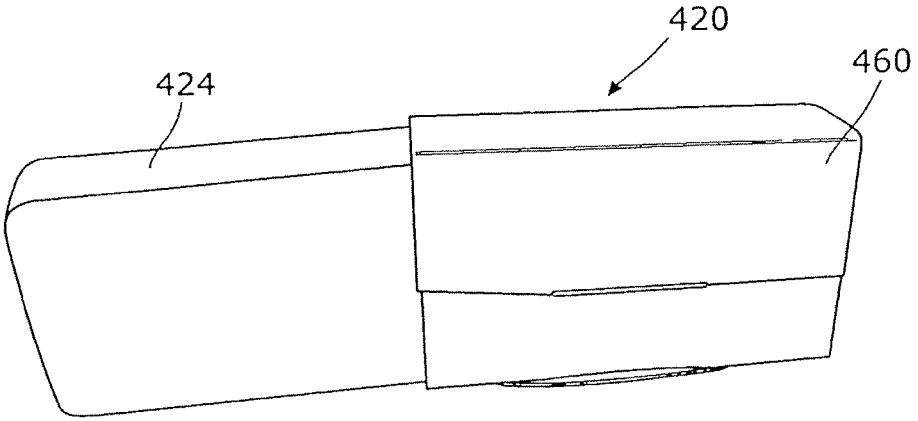
FIG. 11 is a perspective view of a package assembly in accordance with a fifth embodiment of the invention.

FIG. 11 illustrates a further embodiment of a package assembly 420 which includes a cover 460 in a manner similar to the previous two embodiments. However, in this embodiment, the cover does not extend over the full length of the packet 424 but only covers part of the length of the packet in which the opening region is defined. The cover 460 may have three or four panel sections in accordance with either of the two previous embodiments.

In any of the embodiments described above which incorporate a cover 260, 360, 460 having a flap, the flap may be additionally held in the closed position by means of a peelable adhesive or otherwise peelably bonded when the package is initially produced. In some embodiments, it may be advantageous for the flap to be initially held in the closed position by a peelable adhesive only, such that the slot is only used when the package is reclosed. Indeed, the slot could be omitted altogether and the flap held in the closed position by means of a peelable and re-sealable adhesive which may be a cold seal.

Figure 12:
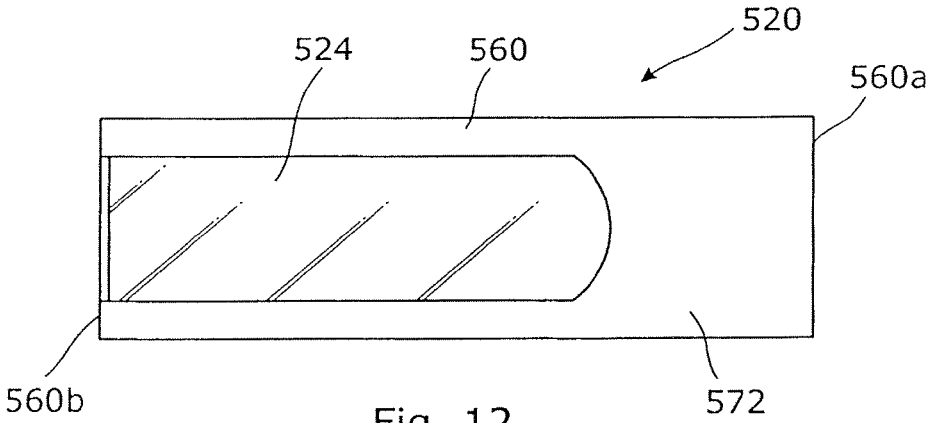
FIG. 12 is a plan view of a package assembly in accordance with a sixth embodiment of the invention.
Figure 13:
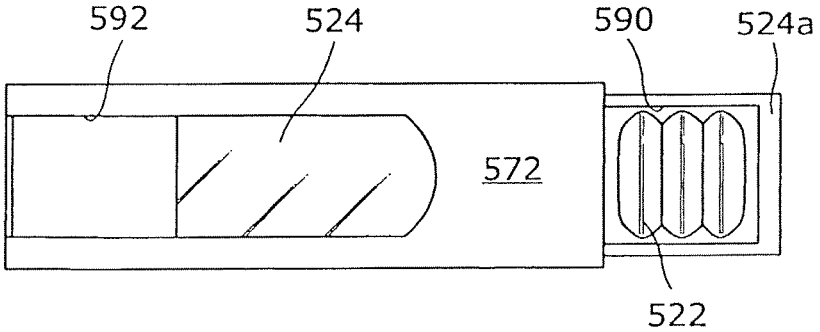
FIG. 13 is a plan view of the package assembly of FIG. 12 in an open condition.

Another embodiment of a package assembly 520 having a cover 560 surrounding the tubular packet 524 is shown in FIGS. 12 and 13. In this embodiment, the cover 560 is in the form of a sleeve which is open at one end 560*a* so that a corresponding end 524*a* of the packet 524 can be slid out of the sleeve through the open end of the cover as illustrated in FIG. 13. A slot 592 is provided in a front face 572 of the cover towards the other end 560*b* of the cover through which a user can contact the packet 524 to slide it out of the open end.

The tubular packet 524 is formed from a wrapper of flexible material in the same manner and from the same or similar materials as the packets described above in relation to the previous embodiments. The cover 560 typically is formed from a blank of foldable material which is typically denser and/or stiffer than the wrapper and which may be cardboard or paperboard or the like, though any suitable materials can be used Such as polymeric materials, including plastics A line of weakness is provided in a front face of the packet 524 to define an opening region adjacent the end 524*a* of the packet which is slid out of the cover. When the package is first assembled, the opening region within the line of weakness is bonded to the inner surface of the front face 572 of the cover so that as the packet is slid out of the cover for the first time, the wrapper is torn along the line of weakness to form a dispensing opening 590 through which the products 522 can be dispensed. The package can be reclosed by sliding packet 524 back into the cover 560 so that the dispensing opening is covered by a solid end region of the front face 572 of the cover.

It will be appreciated that the opening 590 need not be located in the front face of package but can be located anywhere on the packet that is suitable. As discussed in more detail below, the products 522 in the present embodiment are chewing gum pellets having a generally rectangular outer profile. As a result, the packet 524 and the cover 560 are also rectangular in cross section. However, it will be appreciated that the shape of the packet and the cover can be modified for use in packaging differently shaped products.

In any of the embodiments in which a cover 260, 360, 460, 560 is provided, the size of the opening region, and where appropriate the corresponding opening region, can be varied as desired and could be dimension so that only one product can be dispensed at a time through the opening created when the package is first opened.

Figure 14:
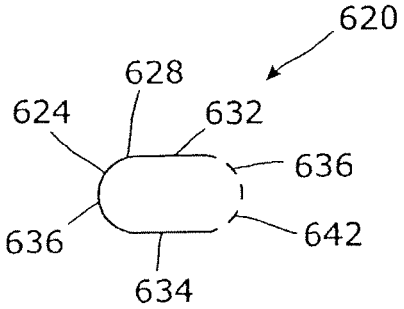
FIG. 14 is a schematic cross sectional view through a side wall region of a tubular packet forming part of a package assembly in accordance with a seventh embodiment of the invention, illustrating schematically the location of an opening region defined in the packet.
Figure 15:
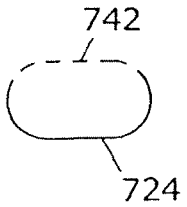
FIG. 15 is a further schematic cross sectional view through a side wall region of the tubular packet of FIG. 14, illustrating schematically an alternative location for an opening region defined in the packet.

In the embodiments described so far, the packaging is designed for use with gum pellets having a generally rectangular outer profile. As a result, the side wall regions of the tubular packets also have a generally rectangular outer profile when viewed in lateral cross section and define two pairs of opposed faces all of which are generally planar. However, this is not essential in all embodiments of the invention and the outer profile of the side wall region can vary depending on the shape of the products being packaged. FIG. 14 for example illustrates a further embodiment of a packaging assembly 620 in accordance with the invention in which the side wall region 628 of the tubular packet 624 has a pair of generally planer front 632 and rear 634 faces and curved side faces 636. In this embodiment, the opening region 642 is located in one of the side faces 636 as indicated by the dashed lines. FIG. 15 illustrates a similar tubular packet 724 but in which the opening region 742 is located in the front face 732. FIG. 16 illustrates a tubular packet 824 suitable for products having a generally square outer profile and in which the side wall region is generally square in lateral cross section. The packet 824 thus has four faces 832, 834, 836*a*, 836*b* of approximately equal width with the opening region 842 being located in one of the side faces 836*a*. Finally, FIG. 17 illustrates a tubular packet 924 suitable for products having a circular outer profile and in which the side wall 926 has a corresponding circular shape in lateral cross section. In this embodiment, the side wall region 926 does not define opposed faces as such but the opening region 942 can be located in the side wall region at an appropriate position, as indicated by the dashed lines. In any of the embodiments shown in FIGS. 14 to 17, the line of weakness can be configured so that the packet is opened by pressing out one of the products through the opening region to rupture the packet along the line of weakness and may be dimensioned and positioned appropriately as described above in relation to the embodiment shown in FIG. 2. It will be appreciated that whilst the position of the opening regions is indicated in FIGS. 14 to 17 by means of dashed lines, where the packet is made from a laminated material, the lines of weakness will usually be formed in only one or some of the layers, which may be an inner layer or layers, so that the integrity of the packet is maintained until it is first opened. The packets 624-924 in the embodiments shown in FIGS. 14 to 17 can be constructed using any of the materials and methods disclosed herein in relation to the previously described embodiments. Correspondingly shaped outer covers similar to those discussed above in relation to FIGS. 4 to 13 can be provided if desired.

References in the description and claims to a peelable adhesive should be understood as including a cold seal adhesive.

It can be seen that the packaging in accordance with the invention provides a simple and cost effective packaging that is easy to open and which, at least in some embodiments, can be effectively re-closed.

The packaging assembly and methods described above can be applied to the packaging of any suitable products but is particularly suitable for use with consumable products, including confectionery products such as gum pellets, when arranged side-by-side in a stack.

The foregoing embodiments are not intended to limit the scope of protection afforded by the claims, but rather to describe examples as to how the invention may be put into practice.

The invention claimed is:

1. A package assembly comprises a plurality of products, a tubular packet enclosing the products and formed from a wrapper of flexible material, the packet having a side wall region encircling the products, the wrapper having at least one line of weakness fully or partially enclosing an opening region of the wrapper located in the side wall region, which opening region can be at least partially removed to create an opening in the wrapper through which one or more of the products may be dispensed by tearing the wrapper along the at least one line of weakness in which the package assembly comprises an outer cover formed from a foldable material of higher density and/or greater stiffness than the wrapper, the outer cover having a flap movable between an open and a closed position, the flap being adhered, directly or indirectly, to the opening region of the wrapper such that on first movement of the flap from the closed position to the open position, the wrapper is torn along the at least one line of weakness to form an opening in the packet;

wherein the cover comprises means for releasably securing the flap in the closed position and a slot or tab with which a free end of the flap engages to releasably hold the flap in the closed position.

2. A package assembly comprises a plurality of products, a tubular packet enclosing the products and formed from a wrapper of flexible material, the packet having a side wall region encircling the products, the wrapper having at least one line of weakness fully or partially enclosing an opening region of the wrapper located in the side wall region, which opening region can be at least partially removed to create an opening in the wrapper through which one or more of the products may be dispensed by tearing the wrapper along the at least one line of weakness in which the package assembly comprises an outer cover encircling the side wall region of the tubular package formed from a foldable material of higher density and/or greater stiffness than the wrapper, the outer cover having a flap movable between an open and a closed position, the flap being adhered, directly or indirectly, to the opening region of the wrapper such that on first movement of the flap from the closed position to the open position, the wrapper is torn along the at least one line of weakness to form an opening in the packet;

wherein the cover comprises a sleeve which extends only part of the length of the tubular packet.

3. A package assembly comprises a plurality of products, a tubular packet enclosing the products and formed from a wrapper of flexible material, the packet having a side wall region encircling the products, the wrapper having at least one line of weakness fully or partially enclosing an opening region of the wrapper located in the side wall region, which opening region can be at least partially removed to create an opening in the wrapper through which one or more of the products may be dispensed by tearing the wrapper along the at least one line of weakness in which the package assembly comprises an outer cover formed from a foldable material of higher density and/or greater stiffness than the wrapper, the cover defining a sleeve surrounding the side wall region of the packet and being open at one end, the packet being slidable in the cover so that at least an end region of the packet can be slid out of the cover at said one end, the opening region of the wrapper being defined at least partially within said end region of the packet and the wrapper within the opening region being bonded to an inner surface of the cover such that when the end region is first slid out of the cover, the wrapper is torn along the at least one line of weakness to produce an opening in the end region of packet.

4. A package assembly as claimed in claim 3, in which a slot is defined in the cover at the opposite end from said one end through which a user may contact the packet in order to slide the end region of the packet out of said one end.

* * * * *